US007045729B2

(12) United States Patent
Matsui et al.

(10) Patent No.: US 7,045,729 B2
(45) Date of Patent: May 16, 2006

(54) SWITCH

(75) Inventors: Takao Matsui, Fukui (JP); Yoshiharu Abe, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/234,211

(22) Filed: Sep. 26, 2005

(65) Prior Publication Data

US 2006/0065512 A1 Mar. 30, 2006

(30) Foreign Application Priority Data

Sep. 27, 2004 (JP) ..... 2004-279060

(51) Int. Cl.
*H01H 1/60* (2006.01)

(52) U.S. Cl. ..... 200/285

(58) Field of Classification Search ..... 200/520, 200/530–532, 536, 541, 238, 252, 253, 285; 508/110

See application file for complete search history.

(56) References Cited

U.S. PATENT DOCUMENTS 4,752,405 A * 6/1988 Kyle et al. ..... 508/404
5,860,513 A * 1/1999 Suzuki ..... 200/268
6,060,626 A * 5/2000 Fujii et al. ..... 568/463
6,255,260 B1 * 7/2001 Stork ..... 508/421
6,455,795 B1 * 9/2002 Murakami et al. ..... 200/345
6,592,264 B1 * 7/2003 Yabe et al. ..... 384/484
6,797,407 B1 * 9/2004 Kato ..... 428/626
6,894,235 B1 * 5/2005 Mihara ..... 200/11 R

FOREIGN PATENT DOCUMENTS

JP 2001-084867 3/2001

* cited by examiner

*Primary Examiner*—Michael A. Friedhofer
(74) *Attorney, Agent, or Firm*—Wenderoth, Lind & Ponack, L.L.P.

(57) ABSTRACT

According to the switch of the present invention, a lubricant containing a base oil, a soft resin polymer, and a surface active agent is applied between a fixed tab and a contact strip that undergo sliding operation in response to vertical movement of an operating part. The soft resin polymer of the composition works effective in minimizing wear of the contacting surfaces of the fixed tab and the contact strip. At the same time, including the surface active agent in the composition can prevents the lubricant from flowing to an undesired section. The lubricant with the composition above can provide a switch with a reliable switch-on/off operation.

1 Claim, 2 Drawing Sheets

SWITCH

FIELD OF THE INVENTION

The present invention relates to a control switch for turning on/off a brake light in response to the operation of the brake pedal of a vehicle.

BACKGROUND ART

In pressing operations of the brake pedal of a vehicle, a press-type switch has been popular in recent years. Through the switch, the brake light is controlled so as to turn on when the brake pedal is pressed and turn off when the pressing force is removed.

First will be described such a conventional switch with reference to FIG. 2. FIG. 2 is a section view of a conventional switch. Case 21 is an insulating resin-made box having an opening on its top. Operating part 22 is also made of insulating resin. On the inner wall of case 21, a plurality of fixed contacts 23 and fixed tab 24 are disposed. Operating part 22 is accommodated in case 21 so as to be movable in the vertical direction.

Movable contact 25 is made of conductive metal. A coil-shaped pressure spring 26 is disposed, in a little contracted state, between movable contact 25 and the bottom of case 21. Urged upwardly by pressure spring 26, movable contact 25 contacts with fixed contacts 23. Fixed contacts 23 are thus electrically connected with each other via movable contact 25.

Conductive metal-made contact strip 27 is disposed in a little contract state in a way that one end is fixed to a side surface of operating part 22, and the other end contacts with a part of the right-side inner wall of case 21 placed upper than fixed tab 24.

Return spring 28 has a coiled shape. Cover 29 covers over the top opening of case 21. Return spring 28, which is disposed in a little contract state between the bottom of operating part 22 and the bottom of case 21, urges operating part 22 upwardly.

Cover 29 has hollow cylinder 29A that protrudes upwardly. Operation rod 22A of operating part 22 is disposed movable through the hollow of the cylinder in the vertical direction, with the top end of operation rod 22A exposed from the cylinder.

As operating part 22 moves in the vertical direction, contact strip 27 slides on fixed tab 24. To encourage a smooth sliding, lubricant 20 is applied to the contact surface between them. Lubricant 20 contains olefin-, or ester-base oil and lithium-, calcium-, or aluminum-based metallic soap.

The switch structured above is placed, in general, upstream from the brake pedal of a vehicle, with operation rod 22A of operating part 22 pressed by an arm (not shown). Terminal section 23A of fixed contacts 23, which protrudes from the bottom of case 21, is connected to a brake light via a connector, while terminal section 24A of fixed tab 24 is connected to electronic circuitry of a vehicle.

While no pressing force is applying to the brake pedal, operation rod 22A of operating part 22 is pressed downwardly. This pressing force contracts pressure spring 26 and return spring 28, lowering movable contact 25 away from fixed contacts 23. That is, movable contact 25 and fixed contacts 23 have no electrical connection; the brake light maintains turn-off state.

In the state, contact strip 27 fixed on the side of operating part 22 goes downward and slides on fixed tab 24 to establish electrical connections therebetween. That is, the electronic circuitry can provide the vehicle with "cruise control" by which the vehicle runs at a constant speed without being stepped the gas pedal.

When the brake pedal is stepped down, the arm goes away from operation rod 22A and therefore rod 22A gets free from the pressing force. Elastic return force of return spring 28 pushes up operating part 22. At the same time, the return force of pressure spring 26 moves movable contact 25 upward to make contact with fixed contacts 23. A plurality of fixed contacts 23 thus establishes electrical connections, so that the brake light turns on.

In the state, contact strip 27 slides on fixed tab 24 and away from it; no more electrical connections and accordingly, the electronic circuitry stops the cruise control.

Fixed contacts 23 and movable contact 25, which are responsible for turning on/off of the brake light, carry a relatively large current of several amperes on 12 volts d. c., whereas fixed tab 24 and contact strip 27, which are responsible for connecting/disconnecting the electronic circuitry, carry a small current of several milliamperes. As described above, lubricant 20 is applied between fixed tab 24 and contact strip 27. On the other hand, no lubricant is provided between fixed contacts 23 and movable contact 25 where an arc occurs in switch-on/off operations due to large current flow.

If lubricant 20 provided between fixed tab 24 and contact strip 27 accidentally attaches to fixed contacts 23 and movable contact 25, reliable switch-on/off operations of the electronic circuitry can be hindered. Considering this, lubricant 20 is, as described earlier, usually formed of olefin- or ester-based oil, not formed of silicon-based material that is easy to generate silica having insulating property by arc.

As a prior-art, for example, the structure disclosed in Japanese Patent Unexamined Publication No. 2001-84867 relates to the present invention.

In the conventional structure, however, lubricant 20 provided between fixed tab 24 and contact strip 27 contains lithium-, calcium-, or aluminum-based metallic soap. In the repeatedly performed sliding operations of contact strip 27 and fixed tab 24 in response to the pressing operation on operating part 22, the metallic compounding agent in the lubricant has gradually worn contact strip 27 and fixed tab 24, and eventually fails to provide a reliable connection therebetween.

SUMMARY OF THE INVENTION

The present invention addresses the problem above. It is therefore the object of the invention to provide a switch capable of offering reliable switch-on/off operations.

According to the switch of the present invention, to achieve the object above, a lubricant, in which a resin polymer and a surface active agent are added to a base oil, is applied between the fixed tab and the contact strip that repeat the sliding movement each time the operating part goes up and down. Softness of the resin polymer of the lubricant minimizes wear of the tab and the strip in the sliding movement. At the same time, including the surface active agent in the composition can prevent the lubricant from flowing away. Such an improved composition of the lubricant allows the switch to provide reliable switch-on/off operations.

DETAILED DESCRIPTION OF THE INVENTION

An embodiment of the present invention is described hereinafter with reference to FIG. 1.

EXEMPLARY EMBODIMENT

Figure 1:
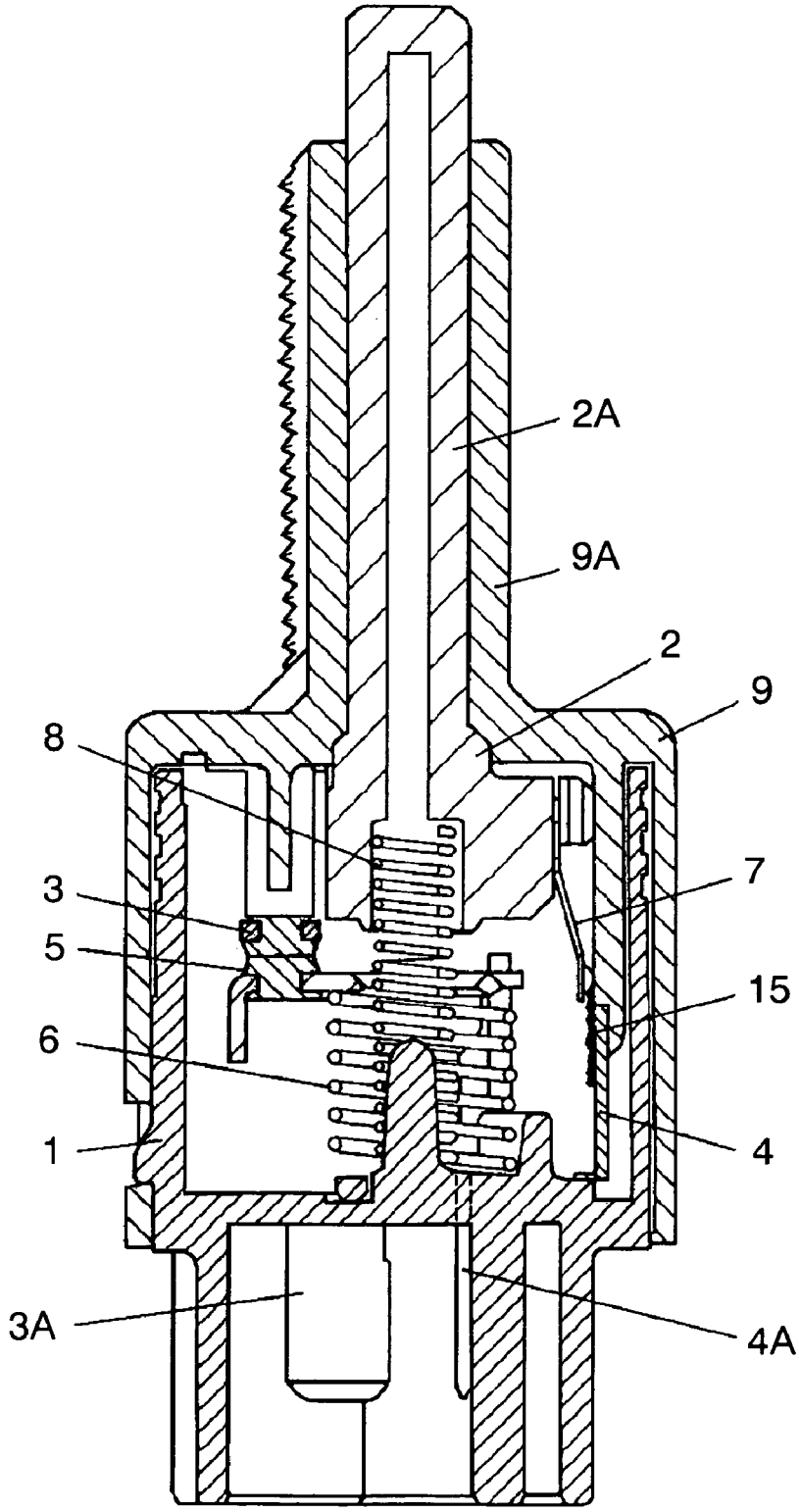
FIG. 1 is a section view illustrating the switch of the embodiment of the present invention.
Figure 2:
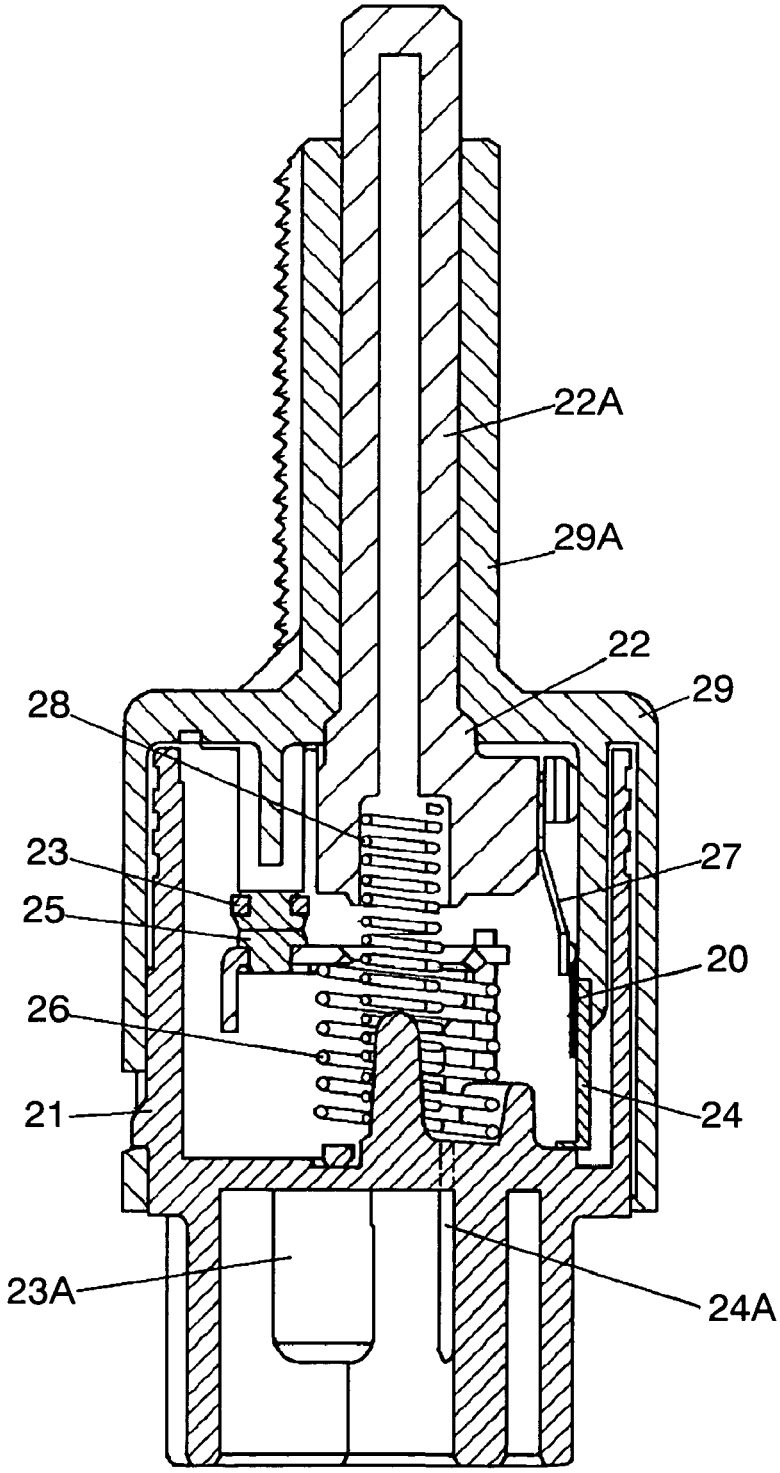
FIG. 2 (PRIOR ART)
FIG. 2 is a section view illustrating a conventional switch.

FIG. 1 is a section view illustrating the switch of an exemplary embodiment of the present invention. Case 1 is an insulating resin-made box having an opening on its top. Operating part 22 has a cylinder shape made of insulating resin. On the inner wall of case 1, a plurality of fixed contacts 3 and fixed tab 4 are disposed. Operating part 2 is accommodated in case 1 so as to be movable in the vertical direction.

Movable contact 5 is made of conductive metal, such as copper alloy. A coil-shaped pressure spring 6 is disposed, in a little contracted state, between movable contact 5 and the bottom of case 1. Urged upwardly by pressure spring 6, movable contact 5 contacts with fixed contacts 3. Fixed contacts 3 are thus electrically connected with each other via movable contact 5.

Contact strip 7 is also made of conductive metal, such as copper alloy. Contact strip 7 is disposed in a little contract state in a way that one end is fixed to a side surface of operating part 2, and the other end contacts with a part of the right-side inner wall of case 1 placed upper than fixed tab 4.

Return spring 8 has a coiled shape. Cover 9 covers over the top opening of case 1. Return spring 8, which is disposed in a little contract state between the bottom of operating part 2 and the bottom of case 1, urges operating part 2 upwardly.

Cover 9 has hollow cylinder 9A that protrudes upwardly. Operation rod 2A of operating part 2 is disposed movable through the hollow of the cylinder in the vertical direction, with the top end of operation rod 2A stuck up from the cylinder.

As operating part 2 moves in the vertical direction, contact strip 7 slides on fixed tab 4. To encourage a smooth sliding, lubricant 15 is applied to the contact surface between them. Lubricant 15 is a mixture of olefin-, or ester-base oil, 1–30 w % of olefin- or ester-based resin polymer, and 0.1–5 w % of fluorine-based surface active agent.

The switch structured above is placed upstream from the brake pedal of a vehicle, with operation rod 2A of operating part 2 pressed by an arm (not shown). Terminal section 3A of fixed contacts 3, which protrudes from the bottom of case 1, is connected to a brake light via a connector, while terminal section 4A of fixed tab 4 is connected to electronic circuitry of a vehicle.

While no pressing force is applying to the brake pedal, operation rod 2A of operating part 2 is pressed downwardly. This pressing force contracts pressure spring 6 and return spring 8, lowering movable contact 5 away from fixed contacts 3. That is, movable contact 5 and fixed contacts 3 have no electrical connection; the brake light maintains turn-off state.

In the state, contact strip 7 fixed on the side of operating part 2 goes downward and slides on fixed tab 4 to establish electrical connections therebetween. That is, the electronic circuitry can provide the vehicle with "cruise control" by which the vehicle runs at a constant speed without being stepped the gas pedal.

When the brake pedal is stepped down, the arm goes away from operation rod 2A and therefore rod 2A gets free from the pressing force. Elastic return force of return spring 8 pushes up operating part 2. At the same time, the return force of pressure spring 6 moves movable contact 5 upward to make contact with fixed contacts 3. A plurality of fixed contacts 3 thus establishes electrical connections, so that the brake light turns on.

In the state, contact strip 7 slides on fixed tab 4 and away from it; no more electrical connections in the electronic circuits and therefore this stops the cruise control.

As operating part 2 moves in the vertical direction, contact strip 7 slides on fixed tab 4. To encourage a smooth sliding with minimized abrasion, lubricant 15 is applied to the contact surface between contact strip 7 and fixed tab 4.

Lubricant 15 has base oil as a major composition and to which olefin- or ester-based soft resin polymer is added. Compared to a lubricant that contains metallic soap, the soft resin polymer-mixed lubricant minimizes abrasion of copper alloy-made contact strip 7 and fixed tab 4, providing a smooth sliding operation.

As another plus, lubricant 15 contains fluorine-based surface active agent. The surface active agent generates a film on the surface of the lubricant to prevent flowing to other sections.

The composition above can not only provide a smooth sliding between contact strip 7 and fixed tab 4, but also prevent the lubricant from attaching to fixed contacts 3 and movable contact 5 where an arc occurs in switch-on/off operations due to large current flow.

According to the present invention, as described above, lubricant 15 has a composition in which a soft resin polymer and a surface active agent are mixed with a base oil. Applying lubricant 15 minimizes wear of fixed tab 4 and contact strip 7 that undergo sliding operations in response to the vertical movement of operating part 2. Besides, the surface active agent contained in the composition prevent lubricant 15 from flowing away. The improved composition of the lubricant allows a switch to have reliable switch-on/off operations.

Although the structure of the present invention is introduced as a press-type switch mainly operated by the brake pedal, it is not limited thereto; the present invention is applicable to other operation ways. For example, the operating part can be tilted or slid in a horizontal direction, instead of being pressed.

The switch of the present invention can provide a reliable response in switch-on/off operations, and is particularly effective in controlling the turn-on/off of the brake light in response to stepping brake pedal of a vehicle.

What is claimed is:

1. A switch comprising:

a box-shaped case on which a fixed tab is disposed;

an operating part accommodated in the case so as to be movable in the vertical direction; and a contact strip that slides on the fixed tab in response to vertical movement of the operating part, wherein, a lubricant in which a resin polymer and a surface active agent are mixed with a base oil is applied between the fixed tab and the contact strip.

* * * * *